United States Patent [19]

Farrell

[11] Patent Number: 4,572,467

[45] Date of Patent: Feb. 25, 1986

[54] ROLLER SHADE MOUNTING BRACKET

[76] Inventor: Regis Farrell, 7634-1 Los Verdes Dr., Rancho Palos Verdes, Calif. 90274

[21] Appl. No.: 593,851

[22] Filed: Mar. 27, 1984

[51] Int. Cl.[4] ..... A47H 1/14

[52] U.S. Cl. ..... 248/257; 248/266

[58] Field of Search ..... 248/257, 266, 269, 256, 248/265, 263, 270, 271, 258, 259, 254, 267; 160/240, 242, 323 B

[56] References Cited

U.S. PATENT DOCUMENTS

| | | | |
|---|---|---|---|
| 1,525,895 | 2/1925 | Sherwood | 248/254 |
| 2,056,111 | 9/1936 | O'Connor | 248/271 |
| 2,241,082 | 5/1941 | Dabelstein | 248/265 |
| 2,433,527 | 12/1947 | Mohr et al. | 248/265 |
| 2,472,220 | 6/1949 | Lyon | 248/257 |
| 2,689,103 | 9/1954 | Ackerman | 248/257 |
| 4,136,847 | 1/1979 | Murray | 248/256 |
| 4,140,294 | 2/1979 | Zwarts | 248/265 |
| 4,270,720 | 6/1981 | Fukuchi | 248/257 |

*Primary Examiner*—Ramon S. Britts
*Assistant Examiner*—Ramon O. Ramirez
*Attorney, Agent, or Firm*—Beehler, Pavitt, Siegemund, Jagger & Martella

[57] ABSTRACT

A mounting bracket for roller shade has two planar mounting portions joined at right angles to each other and a third portion perforated for receiving the end pin of a shade roller attached to one of the mounting portions in parallel relationship thereto but offset therefrom in the direction of the other mounting portion, each of the mounting portions being perforated for receiving mounting fasteners.

5 Claims, 5 Drawing Figures

ROLLER SHADE MOUNTING BRACKET

BACKGROUND OF THE INVENTION

1. Field of the Invention

The present invention pertains to the field of mounting hardware for window shades, curtains and the like, and is more particularly directed to a bracket for the adjustable mounting of window shade rollers.

2. State of the Prior Art

Roller mounted window shades have been in popular use for many years and are typically mounted to the casing of a window by means of brackets which are in turn secured to the wall by means of screws or the like. Many types of mounting brackets for such roller shades have been devised as exemplified by U.S. Pat. Nos. 1,031,898 to Woodworth, 1,338,591 to Richards, 1,230,778 to Ralston. The aforementioned disclosures teach brackets which are adjustable in order to facilitate the task of leveling the roller without requiring excessively careful measurement and placement of the brackets on the window casing or wall surface. The adjustable brackets of the aforementioned patents are all relatively complex and all incorporate several parts which are assembled to make each bracket.

U.S. Pat. No. 2,974,918 to Voigtlander and U.S. Pat. No. 4,167,261 to Bartels disclose universal bracket supports which provide a number of alternative positions at which a separate bracket portion may be affixed. The bracket portion in turn supports the end pin of a roller shade. Thus, multiple parts are required for a complete support bracket.

U.S. Pat. No. 1,581,805 to Kirsch discloses a combination curtain rod and window shade roller bracket which is a single piece bracket perforated with multiple openings each of which is adapted to receive the end pin of a shade roller. The position of the roller relative to the window casing may be adjusted by simply inserting the end pin into the desired opening. Additional openings are provided for receiving screws or equivalent fasteners by which the bracket is affixed to a wall or a window casing surface.

While the Kirsch bracket can be manufactured from a single sheet of material cut and bent to shape, unnecessary complexity remains in that the sheet of metal or other material must be bent along mutually perpendicular pairs of bend lines. Such requirements increase the complexity of the manufacturing process because an additional stamping or bending step is required to form such a bracket as compared to a bracket wherein all of the bend lines are mutually parallel.

SUMMARY OF THE INVENTION

The mounting bracket of the present invention comprises a first portion perforated for receiving fasteners such as screws, or the like, for affixing the bracket to a mounting surface, and a second portion connected to the first portion, the second portion being perforated with roller-pin receiving holes, the holes being arranged in two or more parallel rows, the holes in adjacent rows being staggered relative to each other such that the centers of the holes in one row lie intermediate the centers of adjacent hole pairs in adjacent rows. The first portion of the bracket may include one or more bracket mounting surfaces, each bracket mounting surface having a pair of fastener receiving holes, each pair of fastener receiving holes lying along a line parallel to the rows of holes in the second portion.

The rows of holes in the second portion are aligned such that when the bracket is secured by means of the first portion to a vertical mounting surface such as a vertical wall or window casing, the rows of holes are likewise vertical to allow adjustment of the height of the window shade roller pin supported by the bracket.

The shortcomings of the prior art are further overcome by the one piece mounting bracket of this invention wherein all of the bend lines are mutually parallel thus allowing the bracket to be made in a reduced number steps for more economical manufacture and consequent lower cost to the consumer.

The novel mounting bracket comprises a single sheet of material bent along parallel bend lines into a plurality of planar portions including at least first, second and third planar portions. The first and second portions are joined at a right angle along a first bend line and may both be perforated for receiving wall mounting hardware such as screws or the like. A connecting portion is joined to the second portion along a second bend line. The connecting portion extends from the second portion in the same direction as the first portion, i.e., the first and connecting portions lie on the same side of the second portion. A third planar portion parallel to the second planar portion is joined to the connecting portion along a third bend line. A flange is joined to the third portion along a fourth bend line, the flange extending back towards the plane of the second portion and terminating substantially at that plane. The third planar portion is perforated with a plurality of roller end-pin receiving appertures which allow selective engagement of the pin to the bracket. The connecting portion and the flange act as spacer elements between the perforated third portion and a bracket mounting surface so as to define a space within which may extend the roller pin when supported by the bracket. The flange also serves to stabilize the bracket on a mounting surface while the bracket is being positioned and fixed to a window casing or wall surface, as well as hiding from view the end of the pin when inserted into the bracket.

In a presently preferred embodiment the roller end-pin receiving appertures on the third planar portion are spaced along one or more lines parallel to the bend lines. The pin receiving holes are sized to closely receive the end pin of the shade roller and are closely spaced to each other along the aforesaid parallel lines as well as between adjacent lines to thereby provide a substantially continuous range of selectable positions for the roller pin. Desirably the spacing between adjacent holes is less than one hole diameter and preferably approximates one half hole diameter. The holes of each row are shifted or staggered relative to the holes of adjacent rows, i.e., the centers of the holes of one linear row are aligned with the mid-point between hole centers of the adjacent rows. In this arrangement the highest possible degree of continuity of positioning for the roller pin along a direction parallel to the bend lines is realized in a bracket of minimum complexity and lacking any moving parts.

DETAILED DESCRIPTION OF INVENTION

Figure 1:
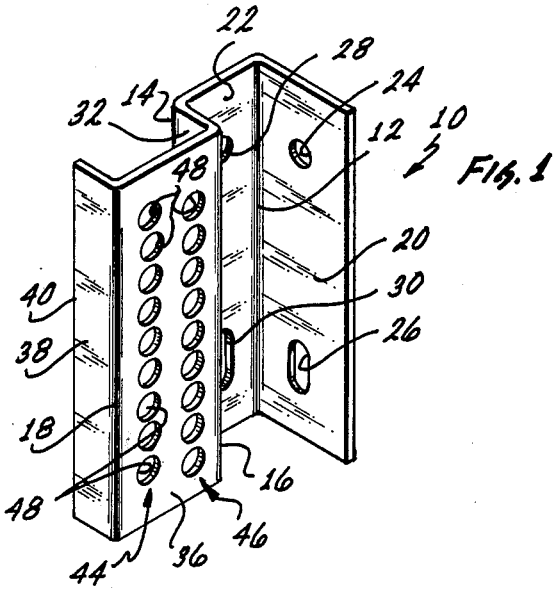
FIG. 1 is a perspective view of the novel bracket of this invention.

With reference to the drawings and FIG. 1 in particular the presently preferred embodiment of the novel roller shade bracket 10 of this invention is formed of a single rectangular piece of sheet metal or the like, bent along four parallel bend lines 12, 14, 16 and 18. The four parallel bend lines devide the rectangular sheet into five planar portions 20, 22, 32, 36 and 38. A first planar portion 20 is joined at the first bend line 12 to a second planar portion 22 at a right angle. The two planar portions 20, 22 provide alternate wall mounting portions for the bracket 10. Each of the portions 20, 22 are perforated as at 24, 26 and 28, 30 respectively for receiving wall mounting hardware such as screws or the like. The lower openings 26, 30 in the respective planar portions 20, 22 may be elongated in the direction of the parallel bend lines so as to provide latitude in the positioning of the first screw or fastener when mounting the bracket to a wall surface prior to fixing the bracket by means of a second screw passing through the upper circular openings 24, 28 respectively.

Figure 3:
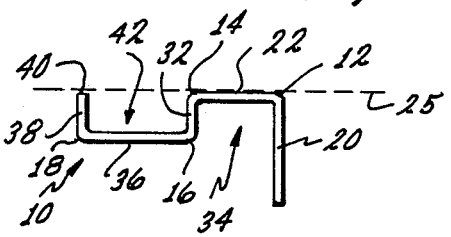
FIG. 3 is an end view of the bracket of FIG. 1.

A connecting portion 32 is joined at the bend line 14 to the second planar portion 22 and extends in the same direction as the first portion 20. The portions 20, 22 and 32 therefore define a first U-shaped channel 34 best seen in FIG. 3.

A third planar portion 36 parallel to the second planar portion 22 is joined at the bend line 16 to the connecting portion 32. It is presently preferred that the connecting portion 32 be perpendicular to both portions 22 and 36. It will be understood however that this rectangular relationship is not essential to the configuration of the novel bracket. A flange 38 is connected to the third planar portion 36 at the fourth bend line 18. The flange 38 terminates at an edge 40 which lies substantially in the plane of the second planar portion 22. Thus, when the bracket is mounted against a mounting surface 25, suggested in dotted line in FIG. 3, by means of the second planar portion 22 and fasteners extending through the fastener openings 28, 30, the edge 40 of the flange 38 also lies against the mounting surface to thereby stabilize the bracket during mounting. The flange 38, third planar portion 36 and the connecting portion 32 together define a second U channel 42 shown in FIG. 3 which is reversed relative to the first U channel section 34. This second U-channel 42 defines a space within which is received the end of the roller pin when a shade roller is mounted to the bracket 10. The bracket will normally be mounted to a window casing or a wall surface with the bend lines vertical relative to a floor surface. Thus, the flange 38 closes the space 42 from normal view so as to hide the end of the roller pin 50 as illustrated in FIG. 5.

Figure 2:
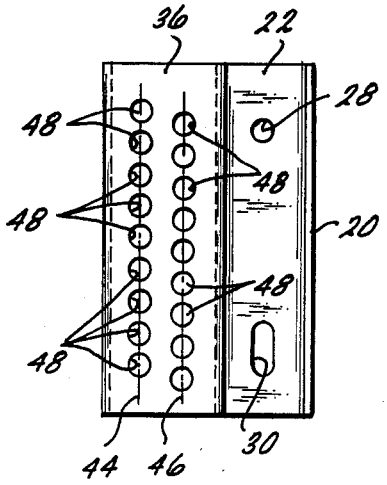
FIG. 2 is a plan view of the perforated pin receiving portion of the bracket.

In the embodiment of FIGS. 1 and 2 the third planar portion 36 is perforated along two rows 44, 46 which are parallel to the bend lines, each row including a plurality of closely spaced pin receiving holes 48. The spacing between holes 48 along each of the rows 44, 46 is desirably of the order of one half the radius of each hole 48 so as to provide a high degree of continuity of adjacent alternate positions for the roller pin along the two parallel lines. The provision of two such parallel rows 44, 46 of holes 48 substantially increases the continuity of possible positions for the roller pin by staggering the holes of the two adjacent rows such that each hole is positioned midway between a pair of holes in the adjacent row. thus, it is possible to adjust the position of the roller pin up or down by a distance as small as one half hole diameter by moving from one to the other of rows 44, 46. While such fine adjustment in a vertical direction entails a corresponding horizontal displacement of the pin equal to the spacing between the lines 44 and 46 such displacement is negligible in comparison to the overall dimensions of the shade roller and are not likely to be noticeable without close scrutiny of the installed roller shade. Further, a displacement or misalignment of the roller in a horizontal direction, i.e., moving the roller closer or farther from an observer is far less noticeable to the average observer and less irritating to the sensitive observer than would be a misalignment or tilt of the roller in a vertical plane, i.e., one end of the roller being mounted higher than the opposite end on the wall or window casing.

Figure 5:
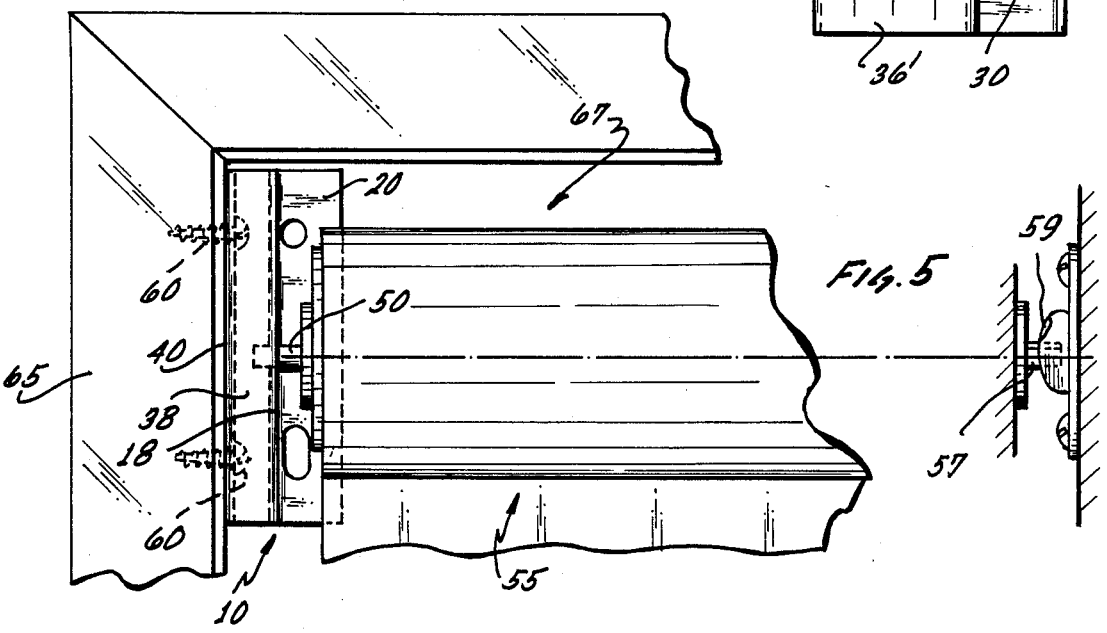
FIG. 5 shows a typical installation of the bracket of this invention.

A typical installation using the novel bracket 10 is illustrated in FIG. 5. The bracket 10 is secured by means of two screws 50 to the casing 65 of a window 67. The end pin 50 of a shade roller 55 is inserted into one of the pin receiving holes 48 of the bracket, while the opposite end of the shade roller, which is normally provided with a flattened winding key or spring engaging shaft 57 of rectangular cross section, may be fixed in a supporting bracket 59 of conventional design. The novel bracket 10 of the invention allows leveling of the roller relative to the window opening by selecting an appropriate pin receiving hole 48 without need for careful measurement in the mounting of the bracket 10 relative to the second bracket 59 supporting the opposite end of the roller.

The first planar portion 20 extends past the third planar portion 36 so as to allow access with a screw driver shaft to the screw openings 24 and 26. In many situations the mounting will be as shown in FIG. 5 with the screws or other fasteners inserted through the holes 28 and 30 in the second portion. In such case the screws are hidden from view by the U-channel defined by the flange 38 together with the connecting section 32 and pin receiving portion 36, thus improving the aesthetic appearance of the installation.

Figure 4:
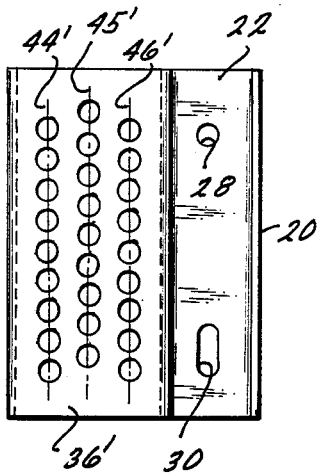
FIG. 4 is a plan view taken as in FIG. 2 but of an alternate bracket enlarged to provide additional pin receiving openings for increased adjustability.

FIG. 4 shows an alternate embodiment of the invention wherein the third planar portion 36 has been enlarged in width in order to accommodate an additional vertical row of pin receiving holes 48 for a total of 3 adjacent rows 44, 45 and 46 thereby allowing additional adjustment of the roller position in the horizontal direction as well the vertical. In all other respects the embodiment of FIG. 4 is similar to that of FIGS. 1 through 3.

The diameter of the pin receiving holes 48 are dimensioned to receive the end-pin 50 of a standard shade roller while allowing free rotation of the pin within the opening 48. The pins of said shade rollers are of standard diameter, approximately one eighth inch in diameter. Due to the small diameter of this pin and by closely spacing the holes 48, and particularly by providing at least two adjacent rows of staggered holes it is possible to provide a nearly continuous range of adjustment for the pin position along the bracket without resorting to moving parts, while retaining a simple bracket configuration based on parallel bend lines for easy manufacture and maximum economy.

It must be understood that many alterations and modifications may be made by those having ordinary skill in the art to the bracket of the present invention without departing from the spirit and scope of the present invention. Therefore, the presently illustrated embodiments have been shown only by way of example and for the purpose of clarity and should not be taken to limit the scope of the following claims.

What is being claimed is:

1. A mounting bracket for a window shade roller comprising a single sheet of material bent along parallel bend lines into a plurality of planar portions, including at least first, second and third planar portions, said first portion being joined at a right angle to said second portion along a first bend line, a connecting portion joined to said second portion along a second bend line and extending from said second portion in the same direction as said first portion, said third portion being parallel to said second portion and joined to said connecting portion along a third bend line, and a flange joined to said third portion along a fourth bend line, said flange terminating substantially at the plane of said second portion, said first and second portions being apertured for receiving fasteners for affixing the bracket to a mounting surface, said third portion having formed therein a plurality of roller-pin receiving apertures.

2. The bracket of claim 1 wherein said roller pin receiving appertures are spaced along one or more rows parallel to said bend lines.

3. The bracket of claim 1 wherein said flange and said connecting portion are of substantially equal width, said width being substantially lesser than the width of said first portion.

4. The bracket of claim 1 wherein a plurality of holes are formed in said third portion, each hole being dimensioned for receiving the end pin of a roller shade, said holes being arranged in a plurality of rows parallel to said bend lines.

5. The bracket of claim 4 wherein adjacent holes along each row are spaced from each other by less than one hole diameter, the holes in adjacent lines being staggered relative to each other.

* * * * *